US005918700A

United States Patent [19]

Gregory

[11] Patent Number: 5,918,700

[45] Date of Patent: Jul. 6, 1999

[54] SCAFFOLDING COMPONENT

[75] Inventor: Ian K. Gregory, Bristol, United Kingdom

[73] Assignee: SGB Services PLC, United Kingdom

[21] Appl. No.: 08/939,307

[22] Filed: Sep. 29, 1997

[51] Int. Cl.[6] ..... E04G 1/15

[52] U.S. Cl. ..... 182/186.8; 182/186.7; 182/119; 182/222

[58] Field of Search ..... 182/186.7, 186.8, 182/119, 222, 179.1

[56] References Cited

FOREIGN PATENT DOCUMENTS

| | | | |
|---|---|---|---|
| 0 409 051 A2 | 1/1991 | European Pat. Off. | E04G 1/14 |
| 0 491 634 A1 | 6/1992 | European Pat. Off. | E04G 1/15 |
| 0491634 | 6/1992 | European Pat. Off. . | |
| 2 247 601 | 5/1975 | France | E04G 7/22 |
| 1463867 | 2/1977 | United Kingdom . | |
| 2 076 878 | 12/1981 | United Kingdom | 182/222 |

*Primary Examiner*—Alvin Chin-Shue

*Attorney, Agent, or Firm*—Jonathan D. Spangler; Arnold, White & Durkee

[57] ABSTRACT

A scaffolding component comprising an inverted channel member and an integral top part, recesses are provided at the juncture of the channel member and the top part for receiving hooks of a platform.

12 Claims, 4 Drawing Sheets

IV
III
A
B

SCAFFOLDING COMPONENT

THE PRESENT INVENTION relates to a scaffolding component, intended to form a horizontal transom and also relating to a scaffolding assembly including horizontal scaffolding components or transoms and transoms which extend between a pair of substantially vertical scaffolding uprights or standards and to support one end of a scaffolding platform or deck plate.

Once a scaffolding assembly has been erected, it is frequently necessary to provide a platform of some description upon which workmen may stand and walk. Typically, removable scaffolding deck plates are used for this purpose and are supported at either end by a horizontal scaffolding component or transom forming part of the scaffolding structure.

It has been proposed previously to provide such scaffolding deck plates with downwardly depending hooks at each end thereof, the hooks being adapted to engage an upper edge of a U-shaped channel section of a respective transom. Whilst this system is clearly more secure than simply laying wooden planks or deck plates on top of transoms, in that it prevents the planks or deck plates sliding off the transoms, significant problems have been experienced regarding vertical movement of the deck plates and hence disengagement of the hooks thereof from the U-sectioned transoms. For instance, when a scaffolding system is used in an exposed area, wind speed can be significant and hence substantial vertical forces may be applied to the deck plates tending to lift them and disengage their hooks from the transoms. This is a particular problem when scaffolding is used against the walls of buildings in areas where high wind speeds occur, since substantial wind deflection occurs resulting in strong eddies and vertical wind components.

It will thus be appreciated that it is advantageous to provide a scaffolding assembly in which some form of locking arrangement is provided to prevent the ends of deck plates becoming disengaged with their supporting cross-members.

Some prior proposed methods of securing the ends of deck plates have involved complicated mechanisms which prevent quick and easy assembly or disassembly of a scaffolding system. Other prior proposed arrangements involve the use of a separate cross-member element disposed substantially vertically above the U-sectioned transom and adapted to prevent vertically upward movement of the ends of said deck plate. However, it has been found disadvantageous to require the use of two horizontal components in such scaffolding assemblies as it makes their erection and subsequent disassembly more complicated and hence labour intensive. It is advantageous to provide scaffolding components which may be simply and easily installed and secured to a scaffolding assembly.

Accordingly, it is an object of the present invention to provide an improved scaffolding component and an improved scaffolding assembly.

According to this invention there is provided a scaffolding component said component comprising a substantially inverted integrally formed channel member, comprising spaced-apart side walls and an upper top part interconnecting the upper edges of the side walls, apertures being formed in the member in the region of the junction between the side walls and the said top part of the channel member, the apertures being such that recesses are provided in an upper part of each side wall, at least part of each recess being immediately adjacent a region of the top part of substantial width and each recess being adjacent a region of the top part of less width, the arrangement being such that a hook may be introduced into each recess by passing the hook through a space defined adjacent the portion of less width and may then be located in the recess with part of the hook member lying under the region of substantial width.

Preferably adjacent recesses in the upper edge of the side wall are separated by upstanding protrusions, each protrusion being substantially aligned with one of said regions of less width of the top part.

Conveniently said channel is formed by stamping said apertures in a metal sheet, and folding the sheet to form said channel.

Advantageously each end of the channel is provided with an end plate presenting oppositely directed tongues.

According to another aspect of this invention there is provided a scaffolding assembly comprising a plurality of scaffolding components as described above, and means to hold the scaffolding components in spaced parallelism and at least one platform supported by the said components, the platform having hooks engaged within said recesses and located under said portions of the upper element of each channel of substantial width.

Conveniently the scaffolding assembly comprises a plurality of uprights, there being securing means located on each said upright, each of said securing means comprising a pair of opposed retaining elements adapted to receive said tongues, one said retaining elements being fixed to the upright and other of said retaining elements being movable along the upright with respect to the fixed retaining element, such that after separation of the retaining elements, one said tongue can be engaged with the fixed retaining element and upon subsequent movement of the movable retaining element towards the fixed retaining element, the oppositely directed tongue is engaged to the movable retaining element, thereby securing the end of a respective scaffolding element to the respective upright.

Preferably at least one of said end plates is configured to engage the exterior of a cylinder.

Advantageously said retaining elements comprise a pair of collars which define opposed annular channels around each upright for the reception of said tongues.

Preferably each fixed collar is welded to a respective upright and defines a channel around said upright which is open at its upper end, and the movable collar is slidably and rotatably mounted on a respective upright above the fixed collar and defines a channel around the upright which is open at its lower end.

Conveniently each of said uprights is provided with engaging means for engaging said movable retaining elements to clamp it against movement away from said fixed retaining element after said tongues have been engaged by the movable element.

Preferably said engaging means comprises a lug on the upright above the fixed collar, and the movable collar has a protrusion in which there is provided a vertical slot through which the lug may pass, the arrangement being such that when the slot is in vertical alignment with said lug the movable collar can be moved freely up and down the upright past the lug, but when the movable collar is moved below the lug and rotated, it is prevented from moving upwardly.

Advantageously the upper surface of the movable collar is inclined upwardly from said protrusion to form a wedge-shaped surface engageable with said lug when the movable collar is below the lug, the arrangement being such that upon rotation of the movable collar below the lug, the inclined surface engages and wedges beneath the lug, the movable collar thus becoming clamped against movement along the upright away from the fixed collar.

In order that the invention may be readily understood, and so that further features thereof may be appreciated, the invention will now be described by way of example, with reference to the accompanying drawings in which.

Figure 1:
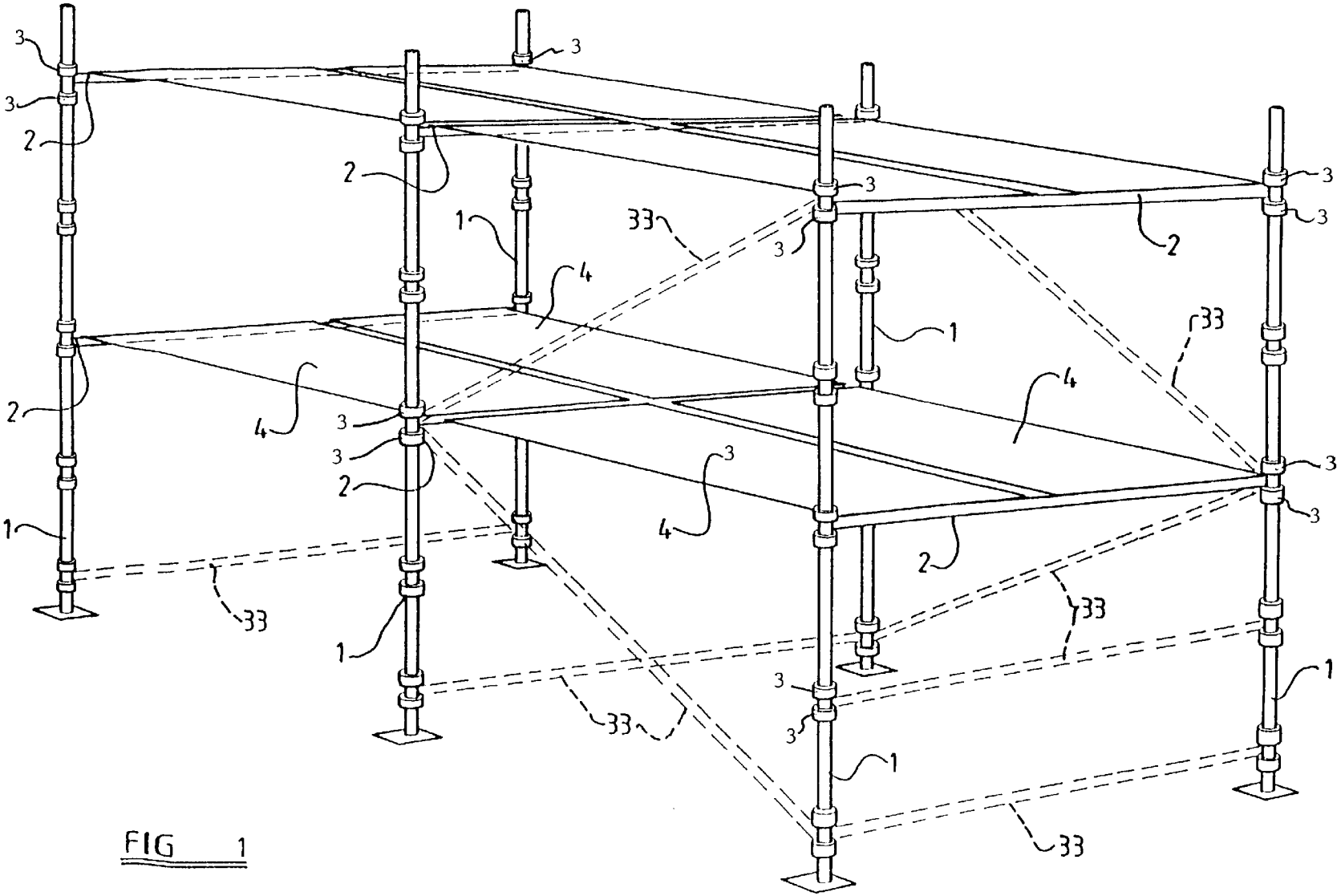
FIG. 1 is a perspective view of a scaffolding assembly in accordance with the present invention.

Referring initially to FIG. 1, there is provided a scaffolding assembly comprising a plurality of substantially vertical uprights 1 arranged in pairs, each pair of uprights 1 having a substantially horizontal scaffolding component 2 extending therebetween. Each upright 1 has a number of securing means 3 located at regular positions along the length of upright 1.

As will also be seen from FIG. 1, there is provided a number of substantially horizontal deck plates 4, each deck plate extending between a pair of spaced-apart horizontal scaffolding components 2. At the ends of each deck plate 4, there is provided at least a pair of downwardly depending hooks, known per se and illustrated schematically at 5 in FIG. 2.

Figures 2, 3, 4:
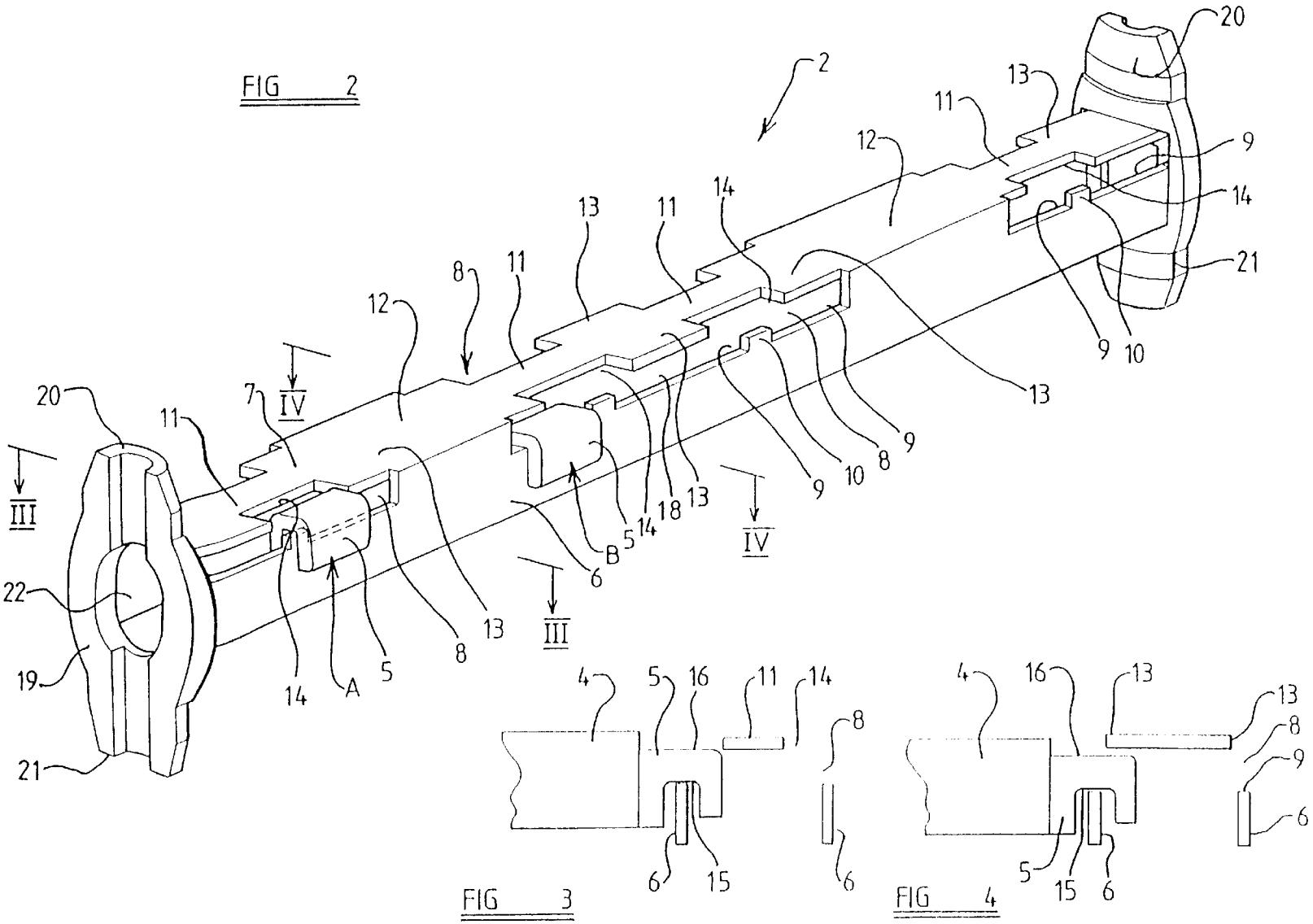
FIG. 2 is a perspective view of a scaffolding component in accordance with the invention forming part of the assembly of FIG. 1.
FIG. 3 is a sectional view taken through line III—III of FIG. 2, schematically illustrating a deck plate with hooks in association with the scaffolding component illustrated in FIG. 2 during an initial stage of assembly.
FIG. 4 is a sectional view corresponding to FIG. 3, taken through line IV—IV of FIG. 2, illustrating the deck plate and scaffolding component during a subsequent stage of assembly.

FIG. 2 illustrates, in more detail, a single horizontal scaffolding component 2. The central part of the scaffolding component 2 is formed from a single sheet of metal which has appropriately shaped apertures stamped therein, and is then folded to form an inverted channel. The inverted channel has two spaced-apart vertical side walls 6 and a transversely extending portion which interconnects the upper edges of the side walls to form the top part 7 of the inverted channel.

As can be seen from FIG. 2, the inverted channel member is provided with apertures 8 which are located at the junction between each of the side walls 6 and the transverse top part 7. The apertures are so configured that the upper edge of each side wall 6, in the region of the apertures 8, is provided with a number of recesses or cutouts 9, the recesses 9 being separated by small upstanding projections 10. The recesses 9 are adapted to receive downwardly depending hooks, such as the hooks 5 shown in FIG. 2 and also illustrated in FIGS. 3 and 4.

It is to be understood, at this stage, that the depending hooks shown in FIG. 2 represent, respectively, two alternate positions of the hooks. Thus one hook is shown in one position and the other hook is shown in another position.

It is to be noted that the top part 7 which interconnects the side walls 6 is provided, in the regions where the edges of the upper elements are defined by the apertures 8, with portions 11 of a reduced width substantially less than the width of the channel defined by the spaced-apart side walls 6 and portions 12 which are actually connected with the upper edges of the side walls 6. In other regions the top part 7 is of substantial width, being provided with laterally outwardly extending projections 13 which extend over selected recesses 9 as defined by the apertures 8. The projections 13 each extend outwardly to a position which is substantially aligned with the vertical side walls 6 which define the inverted channel.

Spaces 14 are defined, on either side of the top part 7, adjacent the portions 11 of reduced width or of less width, between the projections 13 or regions of substantial width. Each space 14 is provided in substantial alignment with an upstanding projection 10 formed at the upper edge of the side wall in the region of an aperture 8 to separate two adjacent recesses 9. The recesses 14 are of greater axial extent than the upstanding projections 10.

In order to attach an end of a deck plate 4 to a scaffolding component 2, firstly each hook 5 thereof is vertically aligned with respect to space 14 formed between adjacent projections 13 of the top part 7. The deck plate may then be lowered such that each hook passes between adjacent projections 13 and assumes a position vertically below the respective space 14 as illustrated in FIG. 3. The hook 5 is then positioned with the undersurface 15 of the hook resting on top of an upwardly extending projection 10 as provided at the upper edge of the side wall 6 between two recesses 9. The upper surface 16 of the hook is thus at a level which is above the undersurface of the portion 11 of reduced width of the top part 7.

The deck plate 4 may then be slipped to one side to a position in which hook 5 is vertically below part of the projection 13, as illustrated in FIG. 4. During this movement the hook is disengaged from the upstanding projection 10 and dropped to a slightly lower level, to be accommodated within the recess 9. Consequently the upper surface 16 of the hook is located at a level which is lower than the undersurface of the projection 13 enabling the hook to be accommodated under the projection 13.

It is to be reiterated that, for the sake of ready understanding of the operation the described embodiment of the invention, the two hooks illustrated in FIG. 2 illustrate a first position of one hook A, and a second position of the other hook B.

As illustrated in FIGS. 2 and 4, after effecting the sideways movement, each hook 5 is allowed to move downwardly, into a respective recess 9, such that the under surface 15 thereof rests upon the upper edge of the side wall 6 that defines the respective recess 9. Each recess 9 is dimensioned to receive a hook 5 therein and to limit the horizontal movement of the hook 5. However, as can be seen from FIG. 2, the centremost recess 9, indicated at 18, is of an increased width such that it may receive a pair of hooks 5 side by side. In this way, a pair of deck plates 4 may be supported side by side with the minimum of space therebetween, each deck plate having a hook 5 disposed at the corner thereof.

The combination of suitably dimensioned recesses 9 and projections 13 extending over a hook 5 located within a respective recess 9, means that in order to disengage a hook 5 from the scaffolding component 2, it is necessary to effect two separate movements. Firstly, the hook 5, and hence the deck plate 4, must be moved vertically upwardly such that the hook 5 is removed from the recess 9. However, this vertical movement is limited by the presence of projections 13 and so each hook 5. Hence the deck plate 4 must then be slid horizontally with respect to the scaffolding component 2 until each hook 5 is located directly below a respective space 14 between adjacent projections 13. The hook 5, and hence the deck plate 4, may then be moved vertically upwardly and released from the scaffolding component 2. This two-stage movement prevents the deck plate becoming dislodged by the wind or accidental contact.

At each end of the scaffolding component, there is provided a vertical end plate 19 which is secured to the end of the channel member defined by the spaced-apart side walls 6 and the transverse top part 7. Each end plate 19 tapers inwardly at its upper and lower ends into laterally upwardly and downwardly depending tongues 20 and 21 respectively. The tongues 20,21 project above and below the channel member formed by the spaced-apart side walls 6 and the top part 7.

Figure 5:
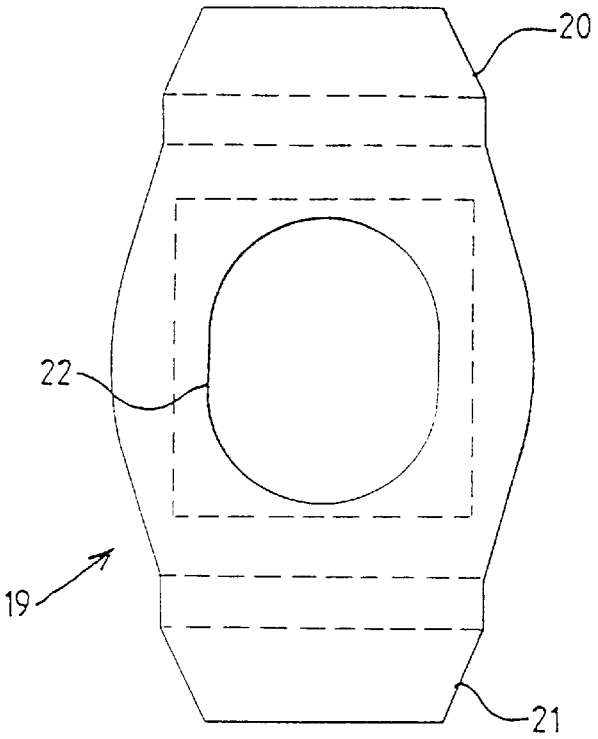
FIG. 5 is a front elevation of part of the scaffolding component illustrated in FIG. 2.
Figure 6:
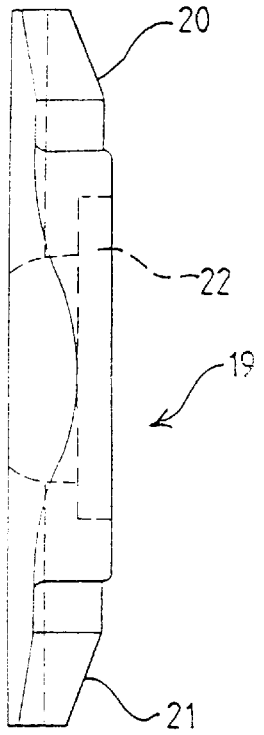
FIG. 6 is a side elevation of the part of the scaffolding component part illustrated in FIG. 5.

Referring now to FIGS. 5 and 6, each plate 19 is in the form of a drop forging having a through aperture 22. The aperture 22 has an enlargement on one face forming a recess that receives the end of the channel formed from the side walls 6 and the top part 7.

Figure 7:
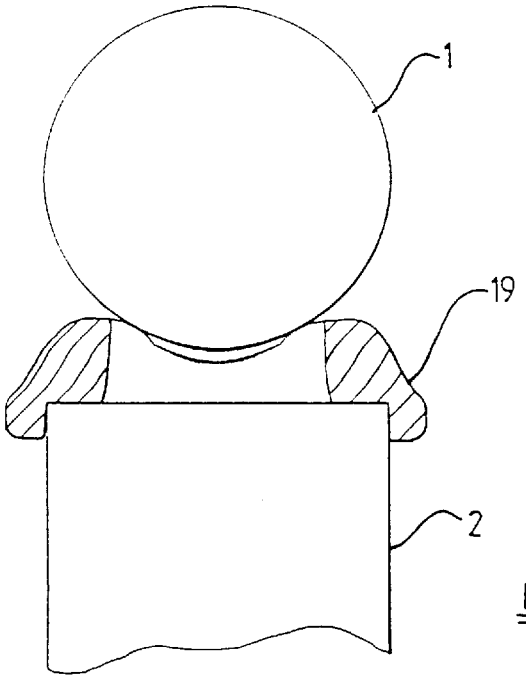
FIG. 7 is a plan view illustrating a scaffolding component part as illustrated in FIGS. 5 and 6, arranged adjacent a scaffolding upright.

As can be seen from FIG. 7, illustrating an end plate 19 in plan form, each end plate 19 is configured to engage the exterior of a cylinder in the form of a scaffolding upright 1. Thus, it is possible to arrange a scaffolding component 2 such that the end plate 19 thereof abuts and fits closely around a section of the outer surface of an upright 1.

Figure 8:
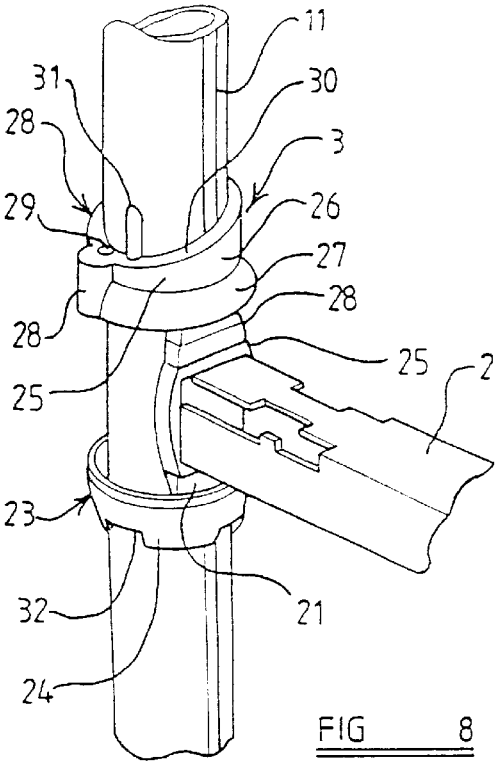
FIG. 8 is a perspective view of a connection between a scaffolding component and a vertical scaffolding upright.
Figure 9:
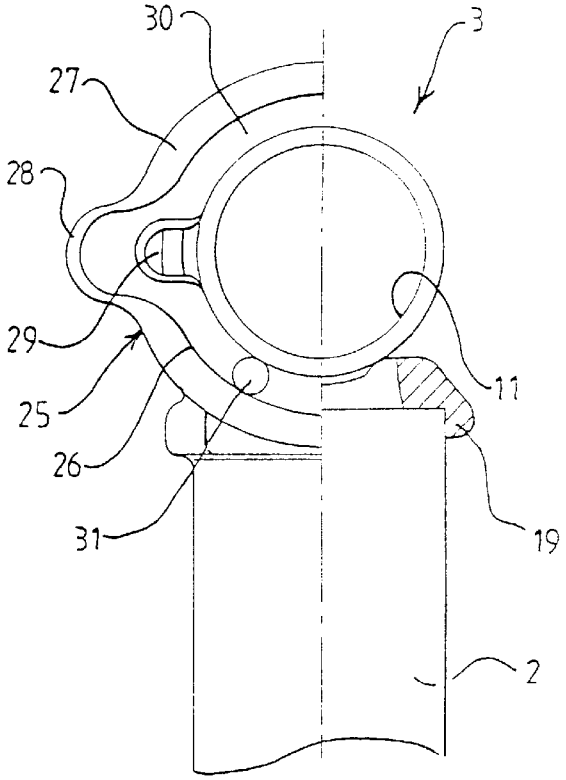
FIG. 9 is a part-plan, part-sectional view of the connection illustrated in FIG. 8.
Figure 11:
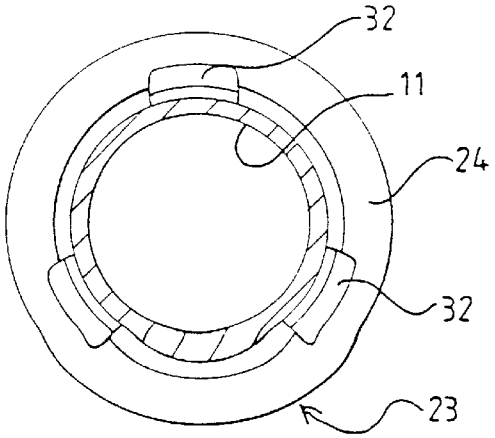
FIG. 11 is a plan view from below of the lower part of the connection illustrated in FIGS. 8, 9 and 10.
Figure 10:
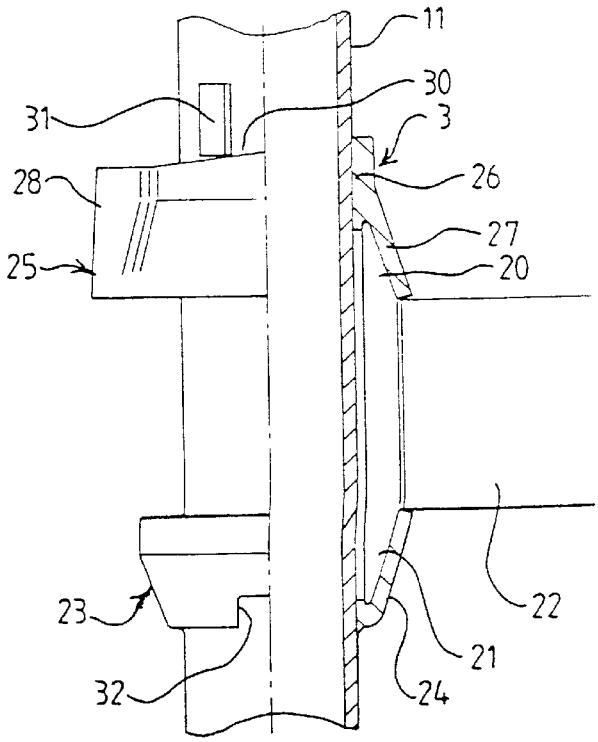
FIG. 10 is a part-side elevation, part-sectional view of the connection illustrated in FIGS. 8 and 9.

Turning now to FIG. 8 of the accompanying drawings, there is illustrated in more detail a connection between a scaffolding component 2 and a securing means 3 of an upright 2.

The securing means 3 comprises, at its lower end, a retaining element in the form of a collar 23 of cup-like form which is welded to an upright 1 so as to define an annular channel around the upright 1, said channel being open at its upper end. The wall of the collar 23 is inclined upwardly and outwardly from the upright 1.

The securing means 3 also comprises, at its upper end, a retaining element in the form of a clamping collar 25 of inverted cup-like form which is slidably mounted on the upright 1 and also defines a channel around the upright 1, the channel in this case, however, being open at its lower end. The side wall of clamping collar 25 has a cylindrical upper part 26 which fits closely around the upright 1 and a downwardly and outwardly inclined lower part 27. At one side, the clamping collar 25 has a radially outwardly directed protrusion 28 in which there is formed, adjacent the upright 1, a vertical slot 29. The top face 30 of the clamping collar 25 may be inclined upwardly from either side of the protrusion 28, as shown, or may be inclined upwardly continuously for a full 360° from one side of the protrusion 28, thus forming a wedge-shaped surface.

A lug 31 is secured to the outer surface of upright 1. Alternatively, it is also possible to form lug 31 integrally with upright 1 during the manufacture of upright 1. Lug 31 is sized so that it may pass through the slot 29 in the protrusion 28 on the clamping collar 25. Thus, when the clamping collar 25 is rotated to a position in which the lug 31 is vertically in line with slot 29, then the clamping collar 25 may be moved up and down the upright 1 past the lug 31.

In order to effect the assembly of a connection between scaffolding component 2 and a securing means 3 of an upright 1, the clamping collar 25 is initially rotated to a position in which the slot 29 is in vertical alignment with the lug 31 so that the clamping collar 25 may be moved upwardly, past the lug 31. The clamping collar 25 is then rotated to a position in which the slot 29 is out of alignment with the lug 31, such that the clamping collar 25 may be rested on top of the lug 31. The lower tongue 21 of the end plate 19 of the scaffolding member 2 may now be inserted into the lower channel defined by the fixed collar 24 on the upright 1. The lower tongue 21, due to its tapered form, fits snugly into the annular channel defined by the fixed collar 24. As previously mentioned, the end plate 19 defines a sector of a cylinder, such that when the tongue 21 has been inserted into the fixed collar 24, the end plate 19 abuts and fits closely around the upright 1.

The clamping collar 25 is now rotated back until the slot 29 formed in the protrusion 28 is in vertical alignment with the lug 31, and is then dropped past the lug 31 and rotated again so that the lug 31 now engages the inclined top surface 30 of the clamping collar 25. By exerting a tangential force on the protrusion 28, for instance with the aid of a hammer, the clamping collar 25 can be wedged tightly beneath the lug 31. The upper tongue 20 on the end plate 19 of scaffolding members 2, due to its generally similar form to the lower tongue 21, wedges tightly in the lower part 27 of the clamping collar 24.

In order to dismantle a connection, the reverse procedure is followed.

The fixed collar 24 is preferably formed with one or more apertures 32 along its lower edge providing drainage means to enable water and dirt to drain from the lower annular channel.

Referring again to FIG. 1, there may also be provided a number of horizontal or diagonal reinforcing braces 33 extending between respective uprights 1 in order to strengthen the scaffolding assembly. Each brace 33 may also be provided with end plates 19 such that it may be connected to securing means 3 on uprights 1. In the case of a diagonal brace 33, the end plates 19 thereof must be secured thereto at an angle to the main body of the brace.

Whilst, in the foregoing description, reference has been made to one particular technique for mounting the inverted channel member in position, it needs to be appreciated that other techniques may be utilised.

I claim:

1. A scaffolding component, comprising:

a substantially inverted integrally formed channel member including a first side wall, a second side wall disposed in spaced relation to said first side wall, and an upper substantially horizontal top part fixed to and abutting upper edges of said first and second side walls;

said channel member including apertures formed proximate the junction between said first and second side walls and said substantially horizontal top part;

said apertures including recesses provided in an upper part of said first and second side walls, at least part of each recess being immediately adjacent a region of the top part having a substantial width and part of each recess being adjacent a region of the top part having a width less than the substantial width such that a hook on a scaffolding deck plate may be introduced into each recess by passing the hook through a space defined by the recess adjacent the top part of lesser width and may then be positioned in the recess with part of the hook member lying under the region of the top part with substantial width to limit the vertical movement of said hook, each respective ends of the channel member and the top part having an integrally formed scaffold coupler connected thereto.

2. A scaffolding component according to claim 1 wherein adjacent recesses in the upper edge of the side wall are separated by upstanding protrusions, each protrusion being substantially aligned with one of said regions of less width of the top part.

3. A scaffolding component according to claim 1 wherein said channel is formed by stamping said apertures in a metal sheet, and folding the sheet to form said channel.

4. A scaffolding component according to claim 1 wherein the coupler comprises an end plate presenting oppositely directed tongues.

5. A scaffolding assembly comprising:

a plurality of scaffolding components, each of said plurality of scaffolding components including a substantially inverted integrally formed channel member having a first side wall, a second side wall disposed in spaced relation to said first side wall, and an upper substantially horizontal top part fixed to and abutting upper edges of said first and second side walls, said channel member including apertures formed proximate the junction between said first and second side walls and said substantially horizontal top part, said apertures including recesses provided in an upper part of said first and second side walls, at least part of each recess being immediately adjacent a region having a the top part of substantial width and part of each recess being adjacent a region of the top part having a width less than the substantial width;

a plurality of vertical uprights, each of said vertical uprights being coupled to an end of one of said plurality of scaffolding components to maintain said plurality of scaffolding components in spaced and parallel relation; and and at least one platform having downwardly depending hooks, wherein said platform may be secured and supported between a pair of scaffolding components by introducing each of said hooks into a respective recess such that said hook is positioned under one of said portions of substantial width in said upper substantially horizontal top part of said channel member to limit the vertical movement of said platform.

6. A scaffolding assembly according to claim 5, comprising:

an end plate fixedly coupled to each end of said channel of each of said plurality of scaffolding components, each said end plate including oppositely directed tongues; and a securing assembly located on each said upright including upper and lower retaining element adapted to receive said tongues of said end plates, said lower retaining element being fixed to each said upright and said upper retaining element being movable along the upright with respect to said lower retaining element such that, after separation of said retaining elements, one said tongue can be engaged with said lower retaining element and upon subsequent movement of upper retaining element towards lower retaining element, the oppositely directed tongue is engaged with said upper retaining element, thereby securing the end of a respective scaffolding component to a respective upright.

7. A scaffolding assembly according to claim 6, wherein at least one of said end plates is configured to engage the exterior of a cylinder.

8. A scaffolding assembly according to claim 6 wherein said retaining elements comprise a pair of collars which define opposed annular channels around each upright for the reception of said tongues.

9. A scaffolding assembly according to claim 8, wherein each fixed collar is welded to a respective upright and defines a channel around said upright which is open at its upper end, and the movable collar is slidably and rotatably mounted on a respective upright above the fixed collar and defines a channel around the upright which is open at its lower end.

10. A scaffolding assembly according to claim 6, wherein each of said uprights is provided with an engagement member for securing said upper retaining elements such that said upper retaining elements will not move away from said lower retaining elements after said tongues have been engaged by upper retaining elements.

11. A scaffolding assembly according to claim 10, wherein said engagement member comprises a lug on the upright above each of said lower retaining elements, each said upper retaining element including a protrusion having a vertical slot through which said lug may pass such that when said slot is in vertical alignment with said lug, said upper retaining element can be moved freely up and down said upright past said lug, but when said upper retaining element is moved below said lug and rotated, said upper retaining element is prevented from moving upwardly.

12. A scaffolding assembly according to claim 11, wherein an upper surface of upper retaining element is inclined upwardly from said protrusion to form a wedge-shaped surface engageable with said lug when said upper retaining element is below said lug such that, upon rotation of said upper retaining element below said lug, said inclined surface engages and wedges beneath said lug, thereby securing said upper retaining element against movement along the upright away from said lower retaining element.

* * * * *